US012687163B1

(12) United States Patent
Bayyouk

(10) Patent No.: US 12,687,163 B1
(45) Date of Patent: Jul. 21, 2026

(54) CATHODIC PROTECTION OF A FLUID END

(71) Applicant: SPM Oil & Gas Inc., Fort Worth, TX (US)

(72) Inventor: Jacob Bayyouk, Richardson, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 19/285,120

(22) Filed: Jul. 30, 2025

(51) Int. Cl.
*F04B 53/10* (2006.01)
*C23F 13/16* (2006.01)

(52) U.S. Cl.
CPC ..... *F04B 53/108* (2013.01); *C23F 13/16* (2013.01); *F04B 53/1087* (2013.01)

(58) Field of Classification Search
CPC ..... F04B 53/108; F04B 53/1087
See application file for complete search history.

(56) References Cited

U.S. PATENT DOCUMENTS 2,263,750 A * 11/1941 Willke ..... F16K 1/42 251/114
3,191,617 A * 6/1965 Maddox ..... F24C 15/104 251/332
4,492,360 A * 1/1985 Lee, II ..... F16K 31/006 251/285
5,249,600 A * 10/1993 Blume ..... F04B 53/1087 137/902
6,142,444 A * 11/2000 Kluge ..... F15C 5/00 137/831
9,228,458 B2 * 1/2016 Reinhart ..... F01L 3/04
9,695,951 B2 * 7/2017 Rodegheri ..... F16K 31/02
10,711,567 B2 * 7/2020 Buckley ..... F16K 1/465
11,795,934 B2 * 10/2023 Kondo ..... F04B 45/047
2011/0308967 A1 12/2011 Byrne
2022/0341305 A1 10/2022 Bayyouk et al.

FOREIGN PATENT DOCUMENTS

CA 1194449 A 10/1985
CN 101397672 A 4/2009
CN 217948269 U 12/2022
DE 10 2014 111 663 A1 2/2016

* cited by examiner

*Primary Examiner* — Eric Keasel

(57) ABSTRACT

A valve assembly of a fluid end of a pump may include a valve seat having a bore defining an inner surface and an outer surface of the valve seat, a first end configured to engage with a valve in a closed position of the valve, and a second end, opposite the first end, defining a groove surrounding the bore. The valve assembly may include a sacrificial ring, positioned in the groove, configured to control corrosion of a fluid end block of the fluid end.

17 Claims, 8 Drawing Sheets

CATHODIC PROTECTION OF A FLUID END

TECHNICAL FIELD

The present disclosure relates generally to fluid pumps and, for example, to cathodic protection of a fluid end of a fluid pump.

BACKGROUND

Hydraulic fracturing is a well stimulation technique in which bedrock is fractured (i.e., fracked) by the application of a pressurized fracking fluid. The effectiveness of fracking fluid is due not only to pressurization, but also to its composition of one or more proppants (e.g., sand) and chemical additives (e.g., dilute acids, biocides, breakers, pH adjusting agents). The application of pressurized fracking fluid to existing bedrock fissures creates new fractures in the bedrock, as well as increases the size, extent, and connectivity of existing fractures. This permits more oil and gas to flow out of the rock formations and into the wellbore, from where they can be extracted.

Hydraulic fracturing pumps generally include a power end and a fluid end, with the power end pressurizing a fracking fluid and the fluid end directing the pressurized fracking fluid into the wellbore through a series of conduits (e.g., pipes). Hydraulic fracking pump components (e.g., a fluid end) that are exposed to fracking fluid are prone to fluid leakage, failure, and other sustainability issues due to corrosion resulting from their exposure to components of the fracking fluid having corrosive or abrasive properties (e.g., proppant, chemical additives). As a result, hydraulic fracking pump components require frequent replacement at a substantial cost. Cathodic protection is a technique used to control corrosion of a metal surface by making the metal surface a cathode of an electrochemical cell. In one embodiment of cathodic protection, the anode of the electrochemical cell serves as a sacrificial metal that corrodes while the more precious cathode remains intact.

The cathodic protection techniques and apparatuses of the present disclosure solve one or more of the problems set forth above and/or other problems in the art.

SUMMARY

Some implementations described herein relate to a valve assembly of a fluid end of a pump. The valve assembly may include a valve seat having a bore defining an inner surface and an outer surface of the valve seat, a first end configured to engage with a valve in a closed position of the valve, and a second end, opposite the first end, defining a groove surrounding the bore. The valve assembly may include a sacrificial ring, positioned in the groove, configured to control corrosion of a fluid end block of the fluid end.

Some implementations described herein relate to a valve assembly of a valve cartridge for a fluid end of a pump. The valve assembly may include an annular valve having a central opening, a perimeter edge, a sealing surface defined between the central opening and the perimeter edge, and a backside surface, opposite the sealing surface, defining a groove surrounding the central opening. The valve assembly may include a sacrificial ring, positioned in the groove, configured to control corrosion of a valve cartridge housing of the valve cartridge.

Some implementations described herein relate to a fluid end of a pump, including a fluid end block defining a discharge bore and a valve assembly installed in the discharge bore. The valve assembly may include a valve and a valve seat having a bore defining an inner surface and an outer surface of the valve seat, a first end configured to engage with the valve in a closed position of the valve, and a second end, opposite the first end, defining a groove surrounding the bore. The valve assembly may include a sacrificial ring, positioned in the groove, configured to control corrosion of the fluid end block.

DETAILED DESCRIPTION

This disclosure relates to cathodic protection of a fluid end, which is applicable to any fluid pump, such as to a valve and/or a valve seat in a fluid end of a fluid pump. The fluid pump may be a hydraulic fracturing pump.

Figure 1:
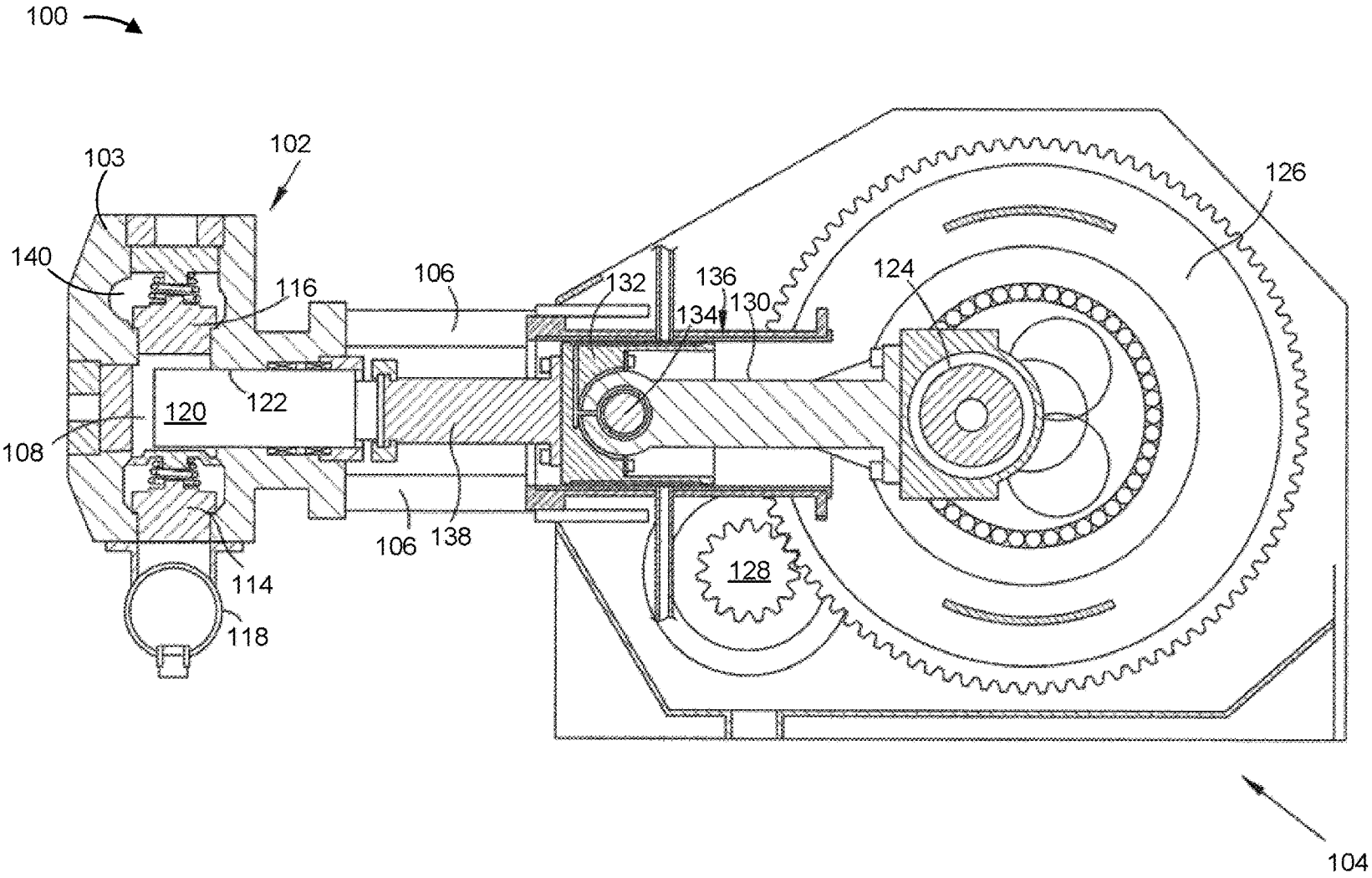
FIG. 1 is a cross-sectional view of an example fluid pump.

FIG. 1 is a cross-sectional view of an example fluid pump 100. In some implementations, the fluid pump 100 may be mounted on a trailer to facilitate transportation of the fluid pump 100 between operational sites. The fluid pump 100 may be a reciprocating pump, as shown.

The fluid pump 100 includes a power end 104 and a fluid end 102 having a fluid end block 103. The fluid end 102 may be connected to the power end 104 by stay rods 106. The fluid end block 103 defines one or more bores 108 (only one shown). For example, the fluid pump 100 may include one, two, three, four, five, or more bores 108 and associated components.

The fluid pump 100 includes a suction valve assembly 114 that is configured to control fluid suction into the bore 108. Similarly, the fluid pump 100 includes a discharge valve assembly 116 that is configured to control fluid discharge from the bore 108. During a suction stroke of a plunger 120, fluid is allowed to flow from a suction manifold 118 through the suction valve assembly 114 and into the bore 108. The fluid is then pumped in response to a discharge stroke (e.g., a forward stroke) of the plunger 120 and flows through the discharge valve assembly 116 into a discharge manifold 140. The discharge manifold 140 may be fluidly coupled to a wellbore to supply high pressure fluid to the wellbore for fracturing rock formations and other uses. In operation, the plunger 120 moves in a plunger bore 122 (e.g., the plunger 120 reciprocates with respect to the plunger bore 122, etc.) and is driven by the power end 104 of the fluid pump 100.

The power end 104 may include a crankshaft 124 that is rotated by a gearbox output 126 (illustrated by a single gear, but may be more than one gear). A gearbox input 128 is coupled to a transmission (not shown) and a power source (not shown), such as a diesel engine, to rotate the gearbox input 128 during operation. A connecting rod 130 mechanically connects the crankshaft 124 to a crosshead 132 via a wrist pin end 134. The crosshead 132 is mounted within a stationary crosshead housing 136, which constrains the crosshead 132 to linear reciprocating movement. A pony rod 138 connects to the crosshead 132 and has its opposite end connected to the plunger 120 to enable reciprocating movement of the plunger 120. The plunger 120 may be one of a plurality of plungers, such as, for example, three or five plungers, depending on the size of the fluid pump 100 (e.g., three cylinder, five cylinder, etc.) and the number of bores 108.

The plunger 120 extends through the plunger bore 122 so as to interface and otherwise extend within the bore 108. In operation, movement of the crankshaft 124 causes the plunger 120 to reciprocate within, or move linearly toward and away from, the bore 108. As the plunger 120 translates away from the bore 108 (a suction stroke of the plunger 120), the pressure of the fluid inside the bore 108 decreases, which creates a pressure differential across the suction valve assembly 114. The pressure differential across the suction valve assembly 114 enables actuation (e.g., opening) of the suction valve assembly 114 to allow the fluid to enter the bore 108 from the suction manifold 118 (e.g., the fluid is pressurized to a low pressure, such as 80 psi, by an outside system, such as a centrifugal pump, and pushed through the suction manifold 118). The pumped fluid is pushed into the bore 108 as the plunger 120 continues to translate away from the bore 108. As the plunger 120 changes directions and moves toward the bore 108 (a discharge stroke of the plunger 120), the fluid pressure inside the bore 108 increases, which creates a pressure differential across the discharge valve assembly 116. Fluid pressure inside the bore 108 continues to increase as the plunger 120 approaches the bore 108 until the pressure differential across the discharge valve assembly 116 is great enough to actuate (e.g., open) the discharge valve assembly 116 and enable the fluid to exit the bore 108.

As indicated above, FIG. 1 is provided as an example. Other examples may differ from what is described with regard to FIG. 1.

Figure 2:
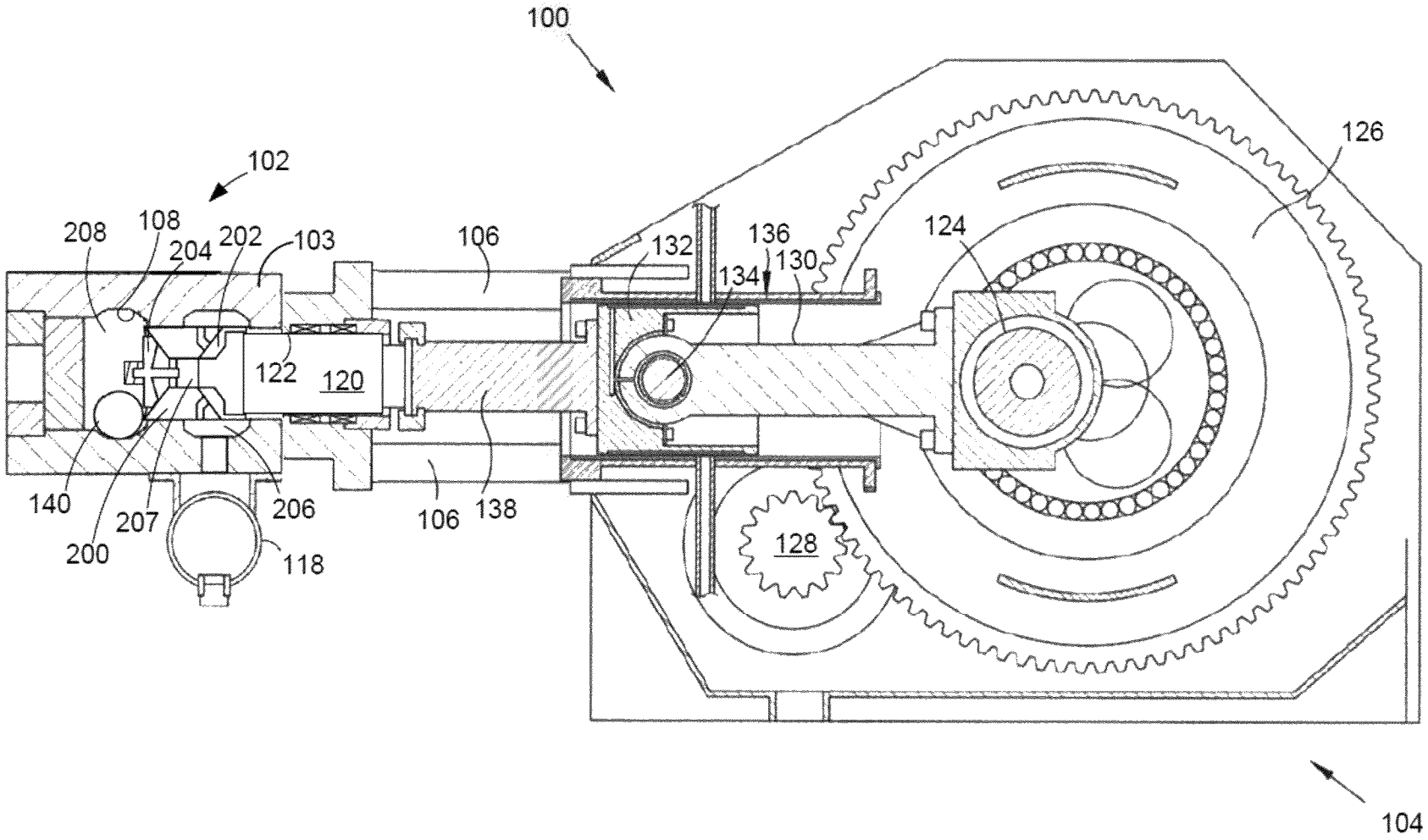
FIG. 2 is a cross-sectional view of an alternative example of a fluid pump.

FIG. 2 is a cross-sectional view of an alternative example of the fluid pump 100. The fluid pump 100 includes a fluid end 102 and a power end 104, in a similar manner as described herein.

The fluid end 102, shown in FIG. 2, may include a valve cartridge 200 disposed in the bore 108 (e.g., a respective valve cartridge 200 may be disposed in each bore 108 of the fluid end 102). For example, the valve cartridge 200 is configured for insertion into, and removal from, the bore 108 as a unit. The valve cartridge 200 includes a suction valve assembly 202 and a discharge valve assembly 204. The bore 108 may be contoured such that when the valve cartridge 200 is disposed in the bore 108, the valve cartridge 200 partitions the bore 108 into a suction chamber 206, a pressure chamber 207, and a discharge chamber 208 of the bore 108. For example, the suction chamber 206 of the bore 108 may be fluidly connected to the suction manifold 118, and the discharge chamber 208 of the bore 108 may be fluidly connected to the discharge manifold 140.

As indicated above, FIG. 2 is provided as an example. Other examples may differ from what is described with regard to FIG. 2.

Figure 3:
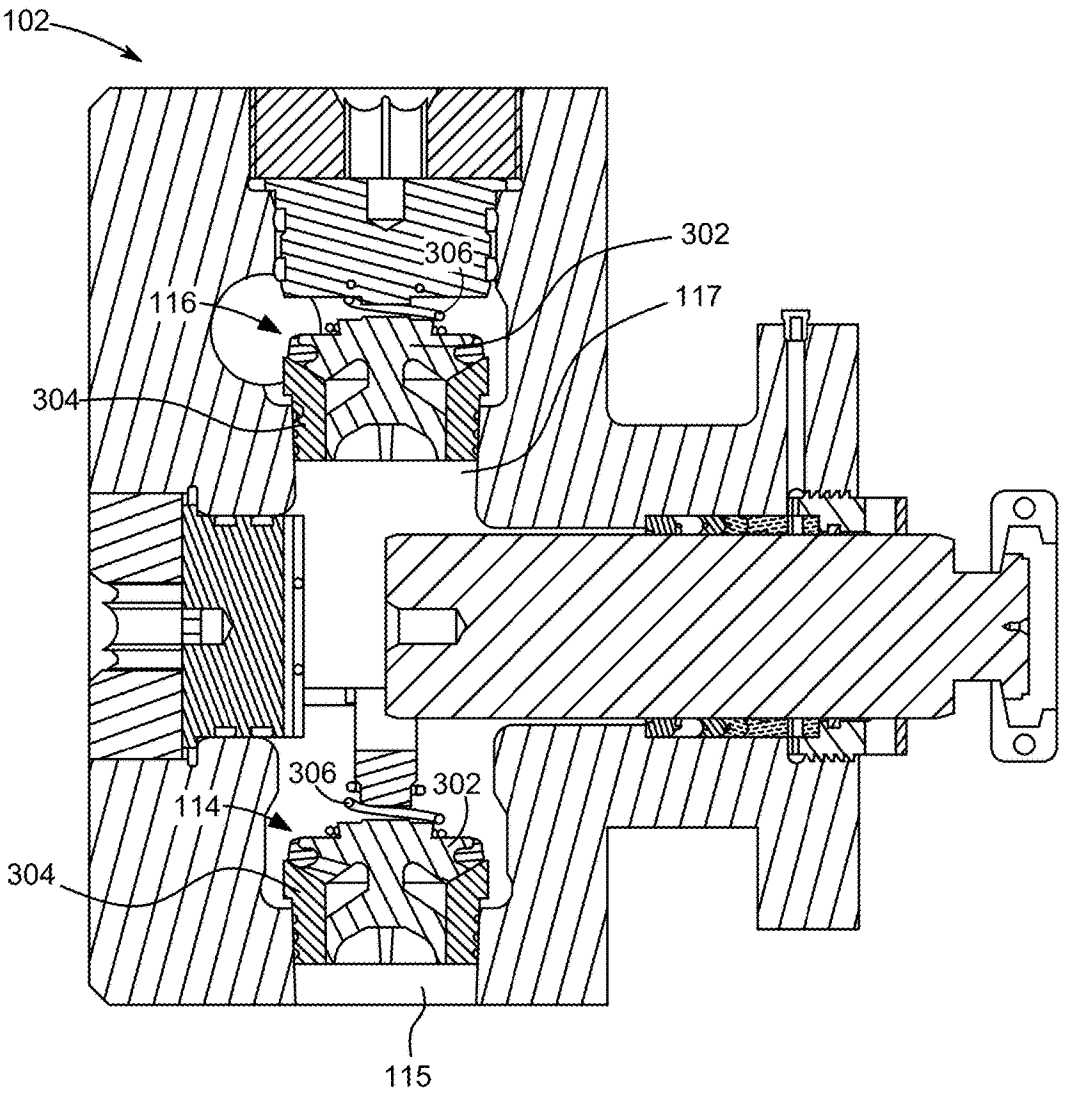
FIG. 3 is a cross-sectional view of an example fluid end.

FIG. 3 is a cross-sectional view of an example fluid end 102, such as the fluid end 102 shown in FIG. 1. As shown and described herein, the fluid end 102 may include a suction valve assembly 114 and a discharge valve assembly 116. The suction valve assembly 114 may be installed in a suction bore 115 of the fluid end block 103, and the discharge valve assembly 116 may be installed in a discharge bore 117 of the fluid end block 103.

The suction valve assembly 114 and/or the discharge valve assembly 116 may include a valve 302, a valve seat 304, and/or a biasing element 306 (e.g., a spring). The valve 302 may be biased by the biasing element 306 to a closed position against the valve seat 304. The valve 302 may move to an open position (e.g., through compression of the biasing element 306) to permit fluid to pass therethrough.

As indicated above, FIG. 3 is provided as an example. Other examples may differ from what is described with regard to FIG. 3.

Figure 4:
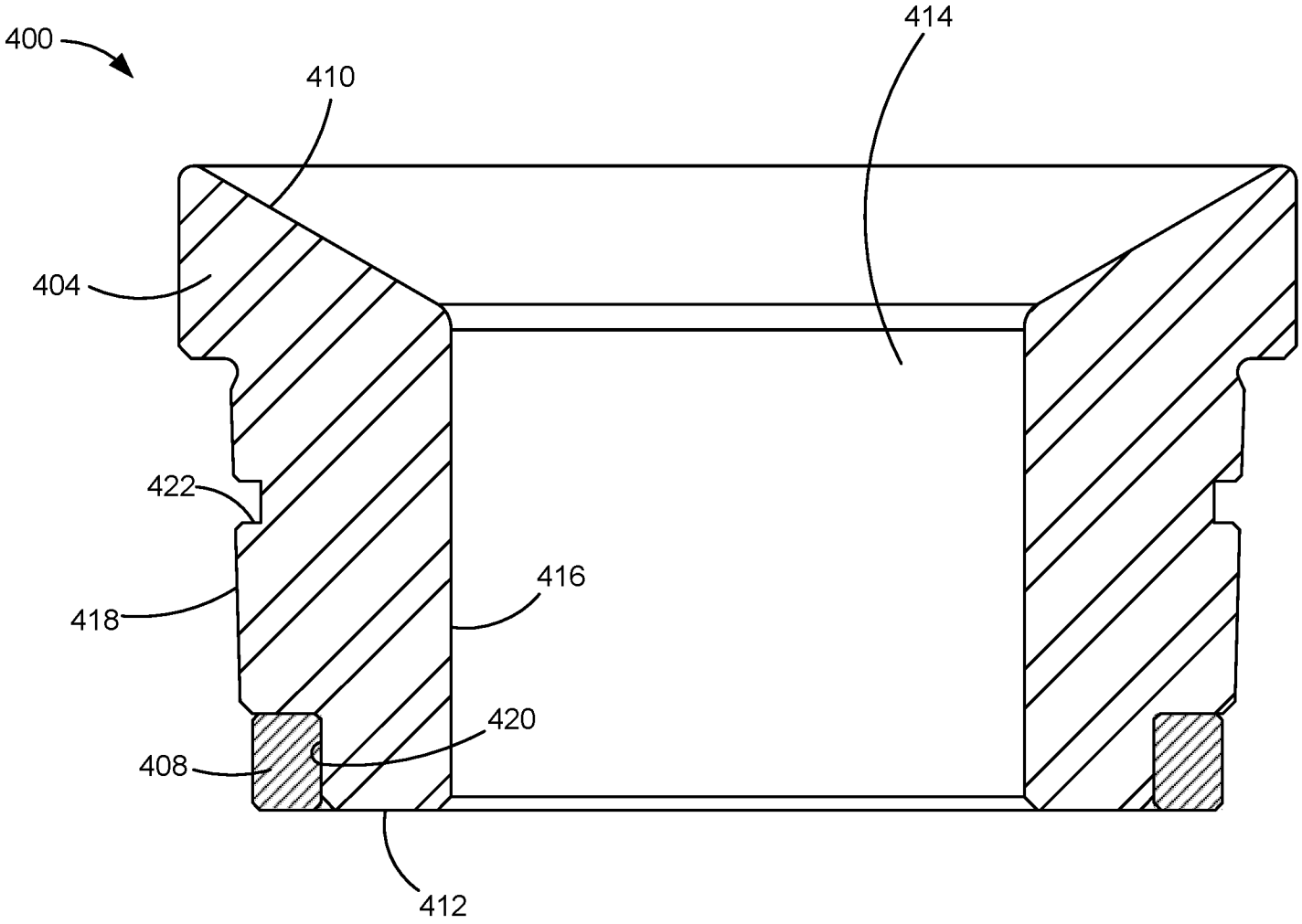
FIG. 4 is a cross-sectional view of an example valve assembly.

FIG. 4 is a cross-sectional view of an example valve assembly 400. As shown, the valve assembly 400 includes a valve seat 404 (e.g., corresponding to valve seat 304) and a sacrificial ring 408. The valve assembly 400 may correspond to at least a portion of the suction valve assembly 114 (e.g., installed in the suction bore 115) and/or the discharge valve assembly 116 (e.g., installed in the discharge bore 117). In some implementations, the valve assembly 400 with the sacrificial ring 408 may be used only in the discharge valve assembly 116 in the discharge bore 117, and the suction valve assembly 114 in the suction bore 115 does not include a sacrificial ring 408.

The valve seat 404 has a first end 410 and a second end 412 opposite the first end 410. The first end 410 may be angled relative to the second end 412. The valve seat 404 has a bore 414 extending from the first end 410 to the second end 412 of the valve seat 404, and the bore 414 defines an inner surface 416 and an outer surface 418 of the valve seat 404. Thus, the bore 414 provides a flow path, for the flow of fluid (e.g., fracking fluid), through the valve seat 404 (e.g., along the inner surface 416 of the valve seat 404).

The first end 410 of the valve seat 404 may be configured to engage with a valve (e.g., valve 302) in the closed position of the valve. The second end 412 of the valve seat 404 may define a groove 420 surrounding the bore 414 (e.g., adjacently surrounding the bore 414 or distanced from the bore 414), and the sacrificial ring 408 may be positioned in the groove 420. In some implementations, the valve seat 404 may define an additional groove 422 in the outer surface 418 of the valve seat 404 located between the first end 410 and the second end 412 of the valve seat 404. A sealing ring may be positioned in the groove 422 to provide a fluid-tight seal with the fluid end block 103.

The sacrificial ring 408 may have an enclosed ring shape (e.g., a continuous ring) or a split ring shape (e.g., a ring with a discontinuity). The sacrificial ring 408 may be coupled to the valve seat 404 by one or more fasteners, an adhesive, a retaining ring, compression, friction, staking, and/or one or more wires, among other examples. The fastener may be a threaded fastener, such as a bolt or a screw. The adhesive may be a conductive adhesive, such as a conductive epoxy. The conductive epoxy may be a two-part epoxy or a one-part epoxy (e.g., a flexible epoxy). The conductive epoxy may include non-silver conductive filler. For example, the conductive filler may include nickel. In some examples, the conductive epoxy may have a coefficient of thermal expansion of about 45 parts per million per degree Celsius (ppm/° C.), a thermal conductivity of about 1.44 watts per meter-kelvin (W(m-K)), a volume resistivity at 25° C. of about 0.02 ohm-centimeters (ohm-cm), and/or a tensile lap shear strength of about 5.5 newtons per square millimeter ($N/mm^2$). In some examples, the conductive epoxy may have a volume resistivity of about 0.02 ohm-cm, a hardness (Shore D) in a range from about 40 to about 60, and/or a tensile lap shear strength of about 9 N/mm$^2$. As used herein, the term "about" may modify a given value by up to ±5%.

The groove 420 may be in the outer surface 418 of the valve seat 404. In some implementations, the groove 420 may run from the outer surface 418 of the valve seat 404 extending inward toward the inner surface 416 of the valve seat 404 (e.g., defining a shoulder of the valve seat 404). For example, the groove 420 may extend partially through a thickness of the valve seat 404 (e.g., defined between the outer surface 418 and the inner surface 416) from the outer surface 418 and without reaching the inner surface 416. Thus, the groove 420 may define a neck in the valve seat 404 where an outer diameter of the valve seat 404 may be at a minimum. In some implementations, the groove 420 may be located in the outer surface 418 of the valve seat 404 between the groove 422 and the second end 412 of the valve seat 404.

Thus, the sacrificial ring 408 may be positioned on the valve seat 404 (e.g., in the groove 420) outside of the flow path through the bore 414. By doing so, the sacrificial ring 408 is sheltered from high pressure fluid flowing through the bore 414, which may otherwise damage or dislodge the sacrificial ring 408 if it were positioned in the high-pressure flow path. Rather, when positioned outside of the flow path, the high-pressure fluid may push on the sacrificial ring 408, thereby promoting the sacrificial ring 408 remaining fixed in its position in the groove 420.

The sacrificial ring 408 may have an inner diameter in a range from about 3.5 inches to about 4 inches, such as about 3.75 to about 3.85 inches. The sacrificial ring 408 may have an outer diameter in a range from about 4.1 inches to about 4.7 inches, such as about 4.4 inches to about 4.5 inches. A thickness of the sacrificial ring 408 may be defined between the inner diameter and the outer diameter of the sacrificial ring 408. The sacrificial ring 408 may have a thickness in a range from about 0.25 inches to about 0.9 inches, such as about 0.55 to about 0.65 inches. A ratio of an outer diameter of the sacrificial ring 408 to an inner diameter of the sacrificial ring 408 may be about 1.1:1, about 1.2:1, or about 1.3:1. By increasing the surface area of the sacrificial ring 408, a cathodic protection provided by the sacrificial ring 408 can also be increased.

An inner diameter of the sacrificial ring 408 may be greater than a minimum inner diameter of the valve seat 404 (e.g., a diameter of the bore 414). For example, a ratio of the inner diameter of the sacrificial ring 408 to the inner diameter of the valve seat 404 may be about 1.5:1 or about 1.45:1. A maximum outer diameter of the valve seat 404 may be greater than an outer diameter of the sacrificial ring 408 (e.g., so that the valve seat 404 engages with a bore of the fluid end block 103 rather than the sacrificial ring 408). For example, a ratio of the maximum outer diameter of the valve seat 404 to the outer diameter of the sacrificial ring 408 may be about 1.2:1, about 1.15:1, or about 1.1:1. A thickness of the sacrificial ring 408 may be less than a maximum thickness of the valve seat 404. For example, the thickness of the sacrificial ring 408 may be at least about 25%, at least about 30%, or at least about 35% of the maximum thickness of the valve seat 404. The neck defined in the valve seat 404 by the groove 420 may have a thickness that is greater than a thickness of the sacrificial ring 408. For example, the thickness of the sacrificial ring 408 may be at least about 50%, at least about 55%, or at least about 60% of the thickness of the neck.

In some implementations, the sacrificial ring 408 may have chamfered inner-diameter corners and/or chamfered outer-diameter corners. Similarly, the valve seat 404 may have chamfered convex corners and/or chamfered concave corners where the sacrificial ring 408 couples with the valve seat 404. This helps ensure a tight interface between the sacrificial ring 408 and the valve seat 404, thereby improving the electrical connection between the sacrificial ring 408 and the valve seat 404.

The sacrificial ring 408 may be configured to control corrosion of one or more components of the fluid end 102. For example, the sacrificial ring 408 may be configured to control corrosion of the fluid end block 103 and/or the valve seat 404, among other examples. As an example, the sacrificial ring 408 may be configured to serve as an anode, and the fluid end block 103 may serve as a cathode of an electrochemical cell. In particular, the sacrificial ring 408 may be configured to control corrosion in the discharge bore 117 of the fluid end block 103, where corrosion may be damaging and may adversely affect operation of the fluid pump 100 due to the high cyclic pressure in the discharge bore 117. Moreover, the position of the groove 420 and the sacrificial ring 408 provides a placement of the sacrificial ring 408 on the valve seat 404 that is near to the fluid end block 103, thereby improving cathodic protection of the fluid end block 103.

The fluid end block 103 may be composed of a metal, such as stainless steel, alloy steel, or carbon steel, among other examples. The cathodic protection provided by the sacrificial ring 408 may be based on a difference in electrode potential between the anode (e.g., the sacrificial ring 408) and the cathode (e.g., the fluid end block 103). For example, anodes can be made up of different metals having different electrode potential. In general, the more negative the electrode potential of the anode with respect to the electrode potential of the cathode, the greater the cathodic protection. Therefore, the sacrificial ring 408 may be composed of metals, such as aluminum, aluminum alloys, zinc, zinc alloys, magnesium, magnesium alloys, or combinations thereof.

As indicated above, FIG. 4 is provided as an example. Other examples may differ from what is described with regard to FIG. 4.

Figure 5:
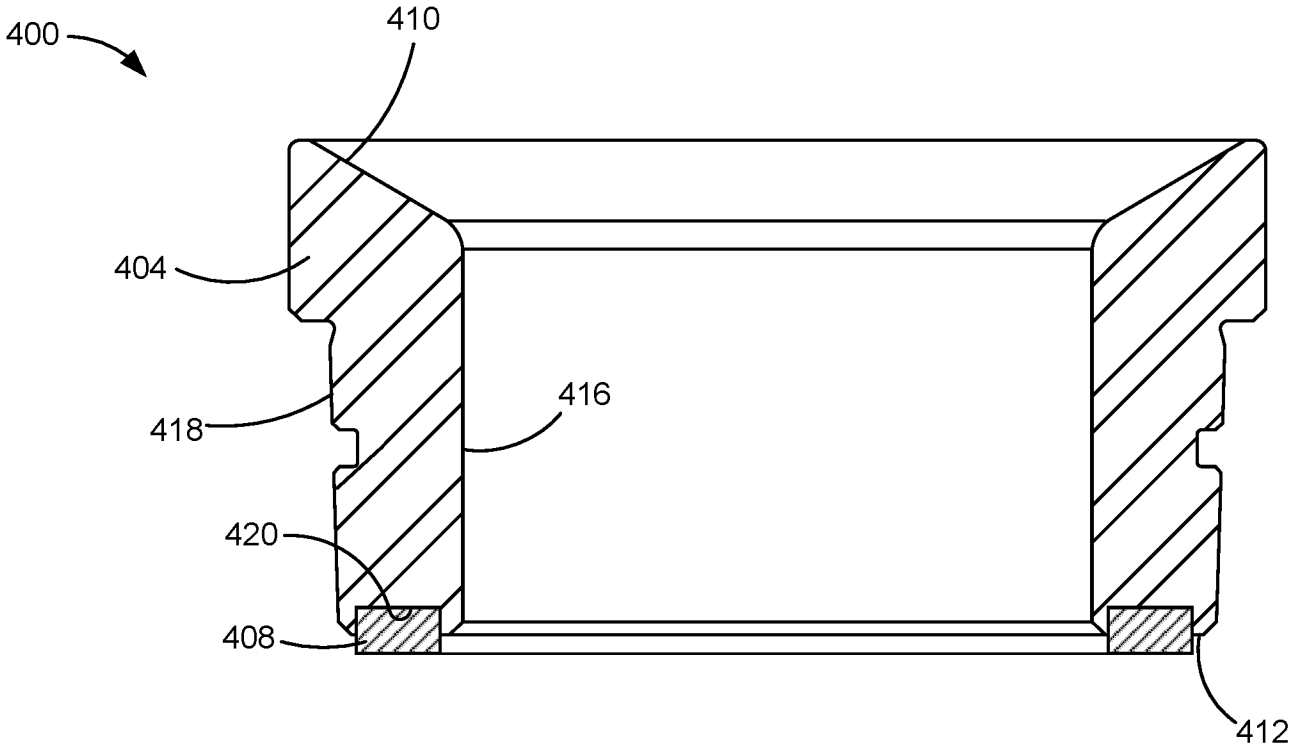
FIG. 5 is a cross-sectional view of an alternative example of a valve assembly.

FIG. 5 is a cross-sectional view of an alternative example of the valve assembly 400. As shown in FIG. 5, the groove 420 may be defined between the outer surface 418 of the valve seat 404 and the inner surface 416 of the valve seat 404. For example, the groove 420 may extend partially through the thickness of the valve seat 404 without reaching the inner surface 416 or the outer surface 418 of the valve seat 404.

In some implementations, a portion of the sacrificial ring 408 may extend beyond the second end 412 of the valve seat 404. For example, a height of the sacrificial ring 408 may be greater than a depth of the groove 420, causing the sacrificial ring 408 to be partially embedded into the groove 420. Doing so increases an exposed surface area of the sacrificial ring 408. This configuration may also be used in the example valve assembly 400. In other implementations, the height of the sacrificial ring 408 may be matched to a depth of the groove 420, such that the sacrificial ring 408 is approximately flush with the second end 412 of the valve seat 404.

As indicated above, FIG. 5 is provided as an example. Other examples may differ from what is described with regard to FIG. 5.

Figure 6:
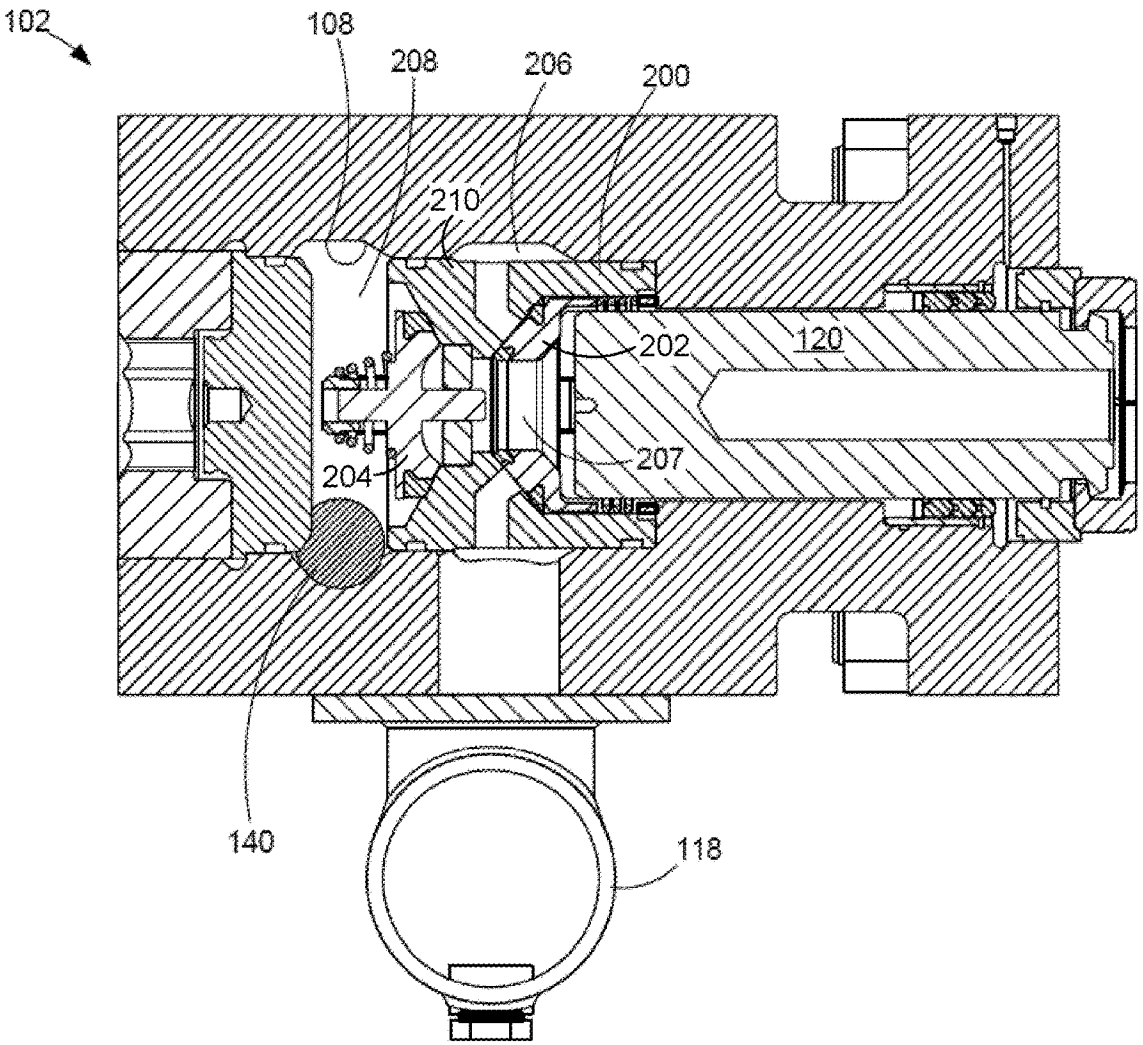
FIG. 6 is a cross-sectional view of an example fluid end.

FIG. 6 is a cross-sectional view of an example fluid end 102, such as the fluid end 102 shown in FIG. 2. The example fluid end 102 of FIG. 6 may include the valve cartridge 200 that is removably disposed in the bore 108. The valve cartridge 200 may be arranged in the bore 108 co-axially with the plunger 120. The valve cartridge 200 may include a valve cartridge housing 210. The valve cartridge housing 210 may define an internal strike face for a valve of the suction valve assembly 202, and an external strike face for a valve of the discharge valve assembly 204. The valve cartridge housing 210 may be composed of a metal, such as stainless steel, alloy steel, or carbon steel, among other examples.

As indicated above, FIG. 6 is provided as an example. Other examples may differ from what is described with regard to FIG. 6.

Figure 7:
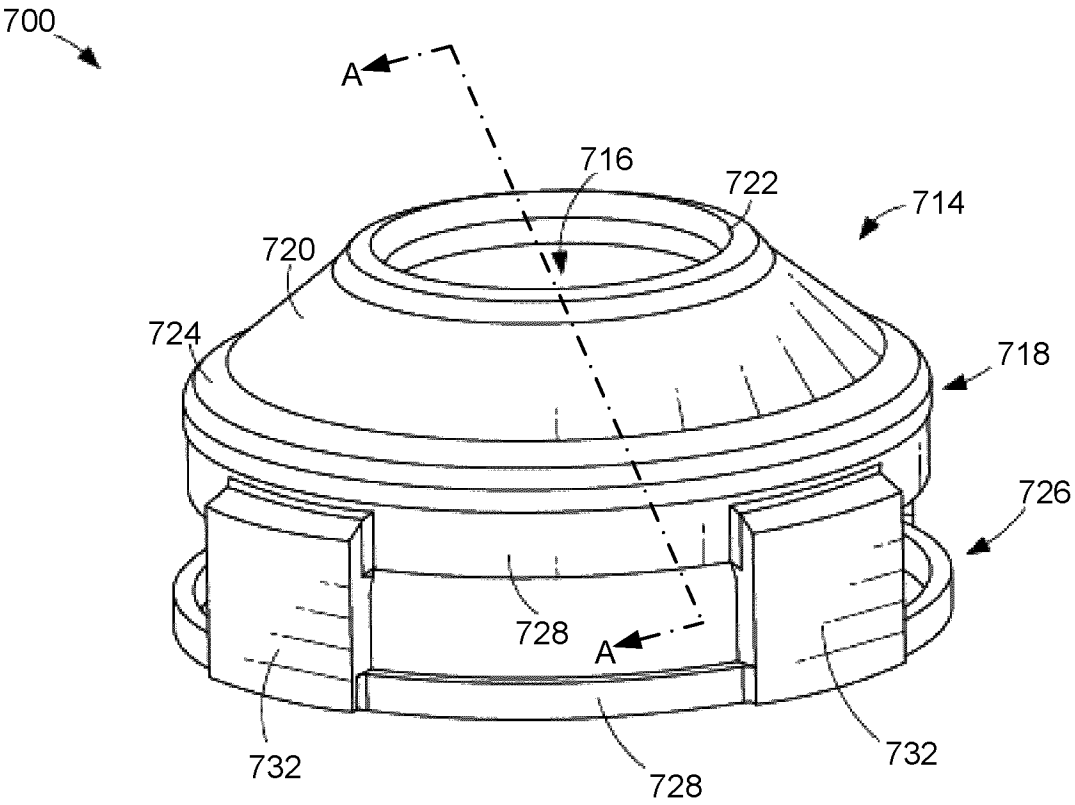
FIG. 7 is a perspective view of an example valve assembly.
Figure 8:
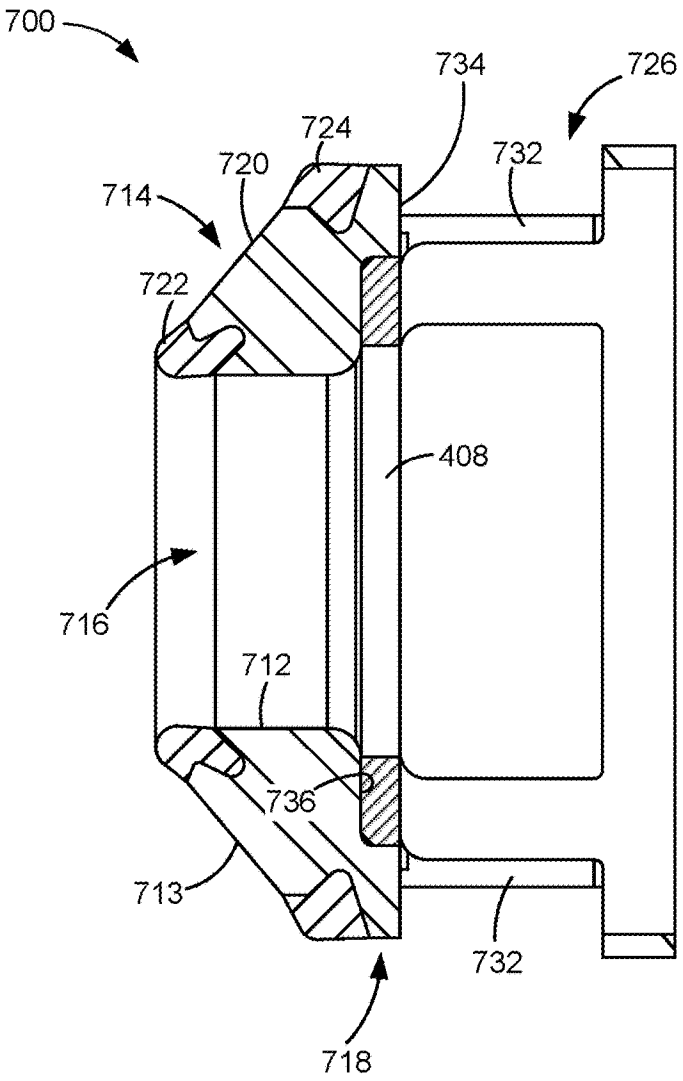
FIG. 8 is a cross-sectional view of the valve assembly of FIG. 7 taken along line A-A.

FIG. 7 is a perspective view of an example valve assembly 700, and FIG. 8 is a cross-sectional view of the valve assembly 700 taken along line A-A. The valve assembly 700 may correspond to at least a portion of the suction valve assembly 202.

The valve assembly 700 may include an annular valve 714 having a central opening 716, a perimeter edge 718, and a sealing surface 720 defined between the central opening 716 and the perimeter edge 718. The central opening 716 defines an inner surface 712 and an outer surface 713 of the annular valve 714. In some examples, the sealing surface 720 may be sloped inwardly from the perimeter edge 718 to the central opening 716, thereby giving the annular valve 714 the shape of a conical frustum. The valve assembly 700 may include a first sealing insert 722 embedded in the sealing surface 720 nearer to the central opening 716 than to the perimeter edge 718. For example, the first sealing insert 722 may be embedded in the sealing surface 720 along the central opening 716. The valve assembly 700 may further include a second sealing insert 724 embedded in the sealing surface 720 nearer to the perimeter edge 718 than to the central opening 716. For example, the second sealing insert 724 may be embedded in the sealing surface 720 along the perimeter edge 718. The first sealing insert 722 and the second sealing insert 724 may be composed of an elastomeric material, such as a urethane, rubber, silicone, latex, or the like.

The valve assembly 700 may include a base component 726 extending from the perimeter edge 718 of the annular valve 714. For example, the annular valve 714 may sit on the base component 726. The base component 726 may include a set of hoops 728. The hoops 728 may be arranged such that openings of the hoops 728 are concentric with the central opening 716. A hoop 728 furthest from the annular valve 714 may engage with a biasing element (not shown in FIGS. 7-8), of the valve assembly 700, configured to act on the base component 726. One or more alignment bars 732 may extend between and connect the hoops 728. Thus, the base component 726 may have a frame-like structure that provides minimal flow resistance, and the alignment bars 732 may help to guide and align the valve assembly 700 (e.g., within the valve cartridge 200).

As shown in FIG. 8, the valve assembly 700 has a backside surface 734 opposite the sealing surface 720. The sealing surface 720 may be angled relative to the backside surface 734. The backside surface 734 may define a groove 736 surrounding the central opening 716 (e.g., adjacently surrounding the central opening 716 or distanced from the central opening 716), and a sacrificial ring 408, as described herein, may be positioned in the groove 736. The sacrificial ring 408 may be coupled to the annular valve 714 by one or more fasteners, an adhesive, a retaining ring, compression, friction, and/or one or more wires, among other examples, as described herein.

The groove 736 may be in the inner surface 712 of the valve seat 404. In some implementations, the groove 736 may run from the central opening 716 of the valve seat 404 extending outward toward the perimeter edge 718 of the annular valve 714 (e.g., defining a counterbore in the backside surface 734 of the annular valve 714). For example, the groove 736 may extend partially through a thickness of the annular valve 714 (e.g., defined between the outer surface 713 and the inner surface 712) from the inner surface 712 and without reaching the outer surface 713. In some implementations, the groove 736 may be defined between the central opening 716 and the perimeter edge 718 of the annular valve 714 (e.g., between the inner surface 712 and the outer surface 713 of the annular valve 714). For example, the groove 736 may extend partially through the thickness of the annular valve 714 without reaching the central opening 716 or the perimeter edge 718 of the annular valve 714 (e.g., without reaching the inner surface 712 or the outer surface 713 of the annular valve 714).

The sacrificial ring 408 may have an inner diameter in a range from about 2.7 inches to about 2.85 inches, such as about 2.8 inches. The sacrificial ring 408 may have an outer diameter in a range from about 3.6 inches to about 3.62 inches (e.g., so that a wall between the groove 736 and the sealing insert 724 is sufficiently thick to withstand high pressures in the valve cartridge 200). The sacrificial ring 408 may have thickness of about 0.2 inches (e.g., to maintain a clearance to the plunger 120).

A ratio of an outer diameter of the sacrificial ring 408 to an inner diameter of the sacrificial ring 408 may be about 1.2:1, about 1.3:1, or about 1.4:1. A ratio of the inner diameter of the sacrificial ring 408 to a thickness of the sacrificial ring 408 to may be about 13.5:1, about 14:1, or about 14.25:1. An inner diameter of the sacrificial ring 408 may be equal to or approximately equal to (e.g., within ±5%) a diameter of the central opening 716. In some implementations, an inner diameter of the sacrificial ring 408 may be greater than a diameter of the central opening 716 (e.g., such that the sacrificial ring 408 is outside of the flow path through the annular valve 714). In some implementations, the sacrificial ring 408 may have chamfered inner-diameter corners and/or chamfered outer-diameter corners, and the backside surface 734 of the annular valve 714 may have chamfered convex corners and/or chamfered concave corners where the sacrificial ring 408 couples with the annular valve 714, in a similar manner as described herein.

The sacrificial ring 408 may be configured to control corrosion of one or more components of the valve cartridge 200 and/or of the fluid end 102 (e.g., the fluid end block 103). For example, the sacrificial ring 408 may be configured to control corrosion of the valve cartridge housing 210 of the valve cartridge 200 (e.g., a strike face of the valve cartridge housing 210 that is engaged by the annular valve 714 in a closed position of the annular valve 714). As an example, the sacrificial ring 408 may be configured to serve as an anode, and the valve cartridge housing 210 may serve as a cathode of an electrochemical cell.

As indicated above, FIGS. 7-8 are provided as an example. Other examples may differ from what is described with regard to FIGS. 7-8.

INDUSTRIAL APPLICABILITY

The valve assemblies 400, 700 described herein may be used with any positive displacement fluid pump (e.g., a reciprocating positive displacement fluid pump). For example, a fluid pump, such as a hydraulic fracturing pump, may use one or more of the valve assemblies 400, 700 in connection with a hydraulic fracturing operation used to recover water, oil, natural gas, and/or other fluids from a rock formation. Pump components (e.g., a fluid end), used in hydraulic fracturing, that are exposed to hydraulic fracturing fluid are prone to pitting, fluid leakage, failure, and other sustainability issues due to corrosion resulting from their exposure to components of the hydraulic fracturing fluid having corrosive or abrasive properties (e.g., proppant, chemical additives).

The valve assemblies 400, 700 provide cathodic protection for fluid end components of a fluid pump. Accordingly, using one or more of the valve assemblies 400, 700, fluid end components (e.g., a fluid end block or a valve cartridge housing) may resist corrosion better, and have a longer useful life, than similar components that do not have the same cathodic protection. For example, by using one or more of the valve assemblies 400, 700, fluid end components may become a cathode that is protected against corrosion while the sacrificial ring 408 corrodes in their place. As the sacrificial ring 408 corrodes, an electrode potential may increase at the fluid end components, meaning that protection against corrosion may decrease. Thus, if the sacrificial ring 408 is used up past a threshold (e.g., an electrode potential threshold, a mass threshold), the sacrificial ring 408 may be replaced with a fresh sacrificial ring to renew protection for the fluid end components. Replacing the sacrificial ring 408 may include uninstalling one or more of the valve assemblies 400, 700 from the fluid end 102, and installing new valve assemblies 400, 700 in the fluid end 102.

The foregoing describes only some embodiments, and alterations, modifications, additions and/or changes can be made thereto without departing from the scope and spirit of the disclosed embodiments, the embodiments being illustrative and not restrictive. Furthermore, implementations are not limited to the disclosed embodiments, and may cover various modifications and equivalent arrangements included within the spirit and scope of the disclosed embodiments. Also, the various embodiments described above may be implemented in conjunction with other embodiments, for example, aspects of one embodiment may be combined with aspects of another embodiment to realize yet other embodiments. Further, each independent feature or component of any given assembly or process may constitute an additional embodiment. As used herein, the singular forms of "a," "an," and "the" include plural referents unless the context clearly dictates otherwise. In addition, as used herein, the term "or" means "and/or" unless the context clearly dictates otherwise.

What is claimed is:

1. A valve assembly of a fluid end of a pump, comprising:

a valve seat having a bore that provides a flow path through the valve seat and defining an inner surface and an outer surface of the valve seat, a first end configured to engage with a valve in a closed position of the valve, and a second end, opposite the first end, defining a groove surrounding the bore outside of the flow path of the valve seat, wherein the groove is from the outer surface of the valve seat extending inward toward the inner surface of the valve seat; and a sacrificial ring, positioned in the groove outside of the flow path of the valve seat, configured to control corrosion of a fluid end block of the fluid end, the valve seat having an outer diameter greater than an outer diameter of the sacrificial ring so that the valve seat is configured to contact the fluid end block without the sacrificial ring contacting the fluid end block.

2. The valve assembly of claim 1, wherein the sacrificial ring is configured to serve as an anode of an electrochemical cell in which the fluid end block serves as a cathode.

3. The valve assembly of claim 1, wherein the groove extends from the second end of the valve seat toward the first end of the valve seat between the outer surface of the valve seat and the inner surface of the valve seat.

4. The valve assembly of claim 1, further comprising:

a conductive adhesive coupling the sacrificial ring to the valve seat.

5. The valve assembly of claim 1, wherein the outer diameter of the valve seat adjacent the sacrificial ring is greater than the outer diameter of the sacrificial ring.

6. The valve assembly of claim 1, wherein an inner diameter of the sacrificial ring is greater than a minimum inner diameter of the valve seat.

7. The valve assembly of claim 1, wherein a thickness of the sacrificial ring is at least 25% of a maximum thickness of the valve seat between the inner surface and the outer surface.

8. A fluid end of a pump, comprising:

a fluid end block defining a discharge bore; and a valve assembly installed in the discharge bore, the valve assembly comprising:

a valve;

a valve seat having a bore that provides a flow path through the valve seat and defining an inner surface and an outer surface of the valve seat, a first end configured to engage with the valve in a closed position of the valve, and a second end, opposite the first end, defining a groove surrounding the bore outside of the flow path of the valve seat, wherein the groove is from the outer surface of the valve seat extending inward toward the inner surface of the valve seat; and a sacrificial ring, positioned in the groove outside of the flow path of the valve seat, configured to control corrosion of the fluid end block, the valve seat having an outer diameter greater than an outer diameter of the sacrificial ring so that the valve seat contacts the fluid end block without the sacrificial ring contacting the fluid end block.

9. The fluid end of claim 8, wherein the fluid end block is composed of stainless steel.

10. The fluid end of claim 8, wherein the sacrificial ring includes one or more of aluminum, aluminum alloy, zinc, zinc alloy, magnesium, or magnesium alloy.

11. The fluid end of claim 8, wherein the groove extends from the second end of the valve seat toward the first end of the valve seat between the outer surface of the valve seat and the inner surface of the valve seat.

12. The fluid end of claim 8, further comprising:

a conductive adhesive coupling the sacrificial ring to the valve seat.

13. The fluid end of claim 8, wherein an inner diameter of the sacrificial ring is greater than a minimum inner diameter of the valve seat.

14. The fluid end of claim 8, wherein a thickness of the sacrificial ring is at least 25% of a maximum thickness of the valve seat between the inner surface and the outer surface.

15. A fluid end of a pump, comprising:

a fluid end block defining a discharge bore; and a valve assembly installed in the discharge bore, the valve assembly comprising:

a valve;

a valve seat having a bore that provides a flow path through the valve seat and defining an inner surface and an outer surface of the valve seat, a first end configured to engage with the valve in a closed position of the valve, and a second end, opposite the first end, defining a groove surrounding the bore outside of the flow path of the valve seat, wherein the groove is from the outer surface of the valve seat extending inward toward the inner surface of the valve seat; and a sacrificial ring, positioned in the groove outside of the flow path of the valve seat, configured to control corrosion of the fluid end block, the valve seat having an outer diameter greater than an outer diameter of the sacrificial ring.

16. The fluid end of claim 15, wherein the groove extends from the second end of the valve seat toward the first end of the valve seat between the outer surface of the valve seat and the inner surface of the valve seat.

17. The fluid end of claim 15, wherein the outer diameter of the valve seat adjacent the sacrificial ring is greater than the outer diameter of the sacrificial ring.

* * * * *